US011401668B1

(12) United States Patent
Apostolopoulos et al.

(10) Patent No.: US 11,401,668 B1
(45) Date of Patent: Aug. 2, 2022

(54) METHOD OF SUSPENDING A PLATFORM FROM A BRIDGE MAIN CABLE

(71) Applicant: Paul Kristen, Inc., Tonawanda, NY (US)

(72) Inventors: Paul Apostolopoulos, Clarence, NY (US); Davy E. Passucci, Clarence Center, NY (US)

(73) Assignee: Paul Kristen, Inc., Tonawanda, NY (US)

( * ) Notice: Subject to any disclaimer, the term of this patent is extended or adjusted under 35 U.S.C. 154(b) by 0 days.

(21) Appl. No.: 17/385,440

(22) Filed: Jul. 26, 2021

Related U.S. Application Data

(62) Division of application No. 16/985,031, filed on Aug. 4, 2020, now Pat. No. 11,072,897, which is a division of application No. 16/199,806, filed on Nov. 26, 2018, now Pat. No. 10,738,423.

(51) Int. Cl.
*E01D 22/00* (2006.01)
*E04G 3/24* (2006.01)
*E01D 19/10* (2006.01)

(52) U.S. Cl.
CPC ..... *E01D 22/00* (2013.01); *E01D 19/106* (2013.01); *E04G 3/24* (2013.01)

(58) Field of Classification Search
CPC ..... E01D 22/00; E04G 3/24
See application file for complete search history.

(56) References Cited

U.S. PATENT DOCUMENTS

| | | | | |
|---|---|---|---|---|
| 4,815,563 | A * | 3/1989 | Puccinelli | E04G 3/30 182/128 |
| 5,145,032 | A * | 9/1992 | Puccinelli | E04G 3/30 182/119 |
| 5,299,655 | A * | 4/1994 | Margaritis | E04G 3/22 182/138 |
| 9,388,589 | B2 * | 7/2016 | Grumberg | E01D 19/106 |
| 10,738,423 | B1 * | 8/2020 | Apostolopoulos | E01D 22/00 |
| 11,072,897 | B1 * | 7/2021 | Apostolopoulos | E04G 3/24 |
| 2004/0020138 | A1 * | 2/2004 | Grearson | E01D 19/106 52/64 |
| 2019/0177988 | A1 * | 6/2019 | Halberg | E04G 3/30 |

* cited by examiner

*Primary Examiner* — Gary S Hartmann
(74) *Attorney, Agent, or Firm* — James C. Simmons

(57) ABSTRACT

A platform and method for erecting a platform of support beams to which decking is applied so that it is suspended from at least one main cable of a bridge. Spaced slings are applied to the main cable so that each extends around the main cable. Ends of each of the slings are attached to a respective one of the support beams respectively. One end of a guy in the form of a cable is attached to at least one of the slings intermediate ends thereof. The guy is extended between the sling and an anchor point to restrain the sling from slippage along the length of the main cable.

20 Claims, 12 Drawing Sheets

METHOD OF SUSPENDING A PLATFORM FROM A BRIDGE MAIN CABLE

This is a divisional of application Ser. No. 16/985,031 filed Aug. 4, 2020, which is a divisional of application Ser. No. 16/199,806 filed Nov. 26, 2018, which applications are hereby incorporated herein by reference.

The present invention relates generally to platforms or scaffolding for performing maintenance work on bridge main cables or cables or the like similarly situated.

Referring to FIG. 1 of the drawings, a typical suspension bridge such as illustrated at 20 has on each side a main cable, illustrated at 22, but, as illustrated in FIG. 4, may have a pair or more of such main cables 22 on each side. Vertical hangers or suspender cables 24 periodically attach the deck 26 to the main cables 22 to transmit the load of the deck 26 thereto. The hangers 24 are attached to the main cables 22 by means of bands, illustrated at 28 in FIG. 4 and positioned at the location indicated in FIG. 1, attached to the main cables 22. The main cables 22 are supported by one or more central pylons 30 and tensioned by ground anchorings, as at 32, at the ends of the bridge 20, the main cables 24 transferring the load to the pylons 30. A band 28, which is well known in the art, comprises a pair of generally semi-cylindrical sections attached by a pair of pluralities of fasteners at edges of the sections so as to grip the main cable, and formations 29 are provided thereon for routing and holding the suspender cables 24 around the band 28. Bars 31 are conventionally attached to the bands 28 to support cables (not shown) that workers can hold onto while walking the main cables 22.

The main cables 22 require periodic painting and/or other maintenance. Such maintenance has typically been performed by the workers walking on the main cable 22 and holding onto ropes which runs parallel to the cable. The rope supports are attached to the bands 28. For safety concerns, this kind of worker support requires shut-downs of some or all of the lanes of the bridge, which is not only inconvenient to the public but also has economic consequences. A suitable temporary platform erected beneath a main cable would alleviate such safety and economic concerns and provide greater convenience to the workers.

The assignee of the present application has for many years erected temporary platforms beneath bridges. One such platform comprises a plurality of parallel length-wise running cables upon which is laid decking, the cables attached at their ends to the bridge or other structure. Such temporary platforms are illustrated in U.S. Pat. Nos. 6,523,644; 6,386,319; 6,302,237; 6,264,002; 6,227,331; 6,138,793; 6,135,240; 6,003,634; 5,921,346; and 5,730,248, all of which are incorporated herein by reference and which are assigned to the assignee of the present invention. In such platforms, a tie-back may be attached at one end to a plate or the like attached to the bridge structure and at the other end to a portion of a platform to provide additional support thereto. FIG. 2 of the present drawings illustrates schematically at 34 a conventional use of tie-backs attached at one end to the platform and at the other end to bridge or other structure to support and brace the platform against movements due to wind.

U.S. Pat. No. 9,103,081 discloses a below main cable platform support for hanging a work platform below a main cable of a suspension bridge. A plurality of supports attach to each band on a main cable. Each support has a pair of struts bolted to the band, the top of a strut on each side of the band. The struts extend downward, connecting to the ends of a horizontal bar that sits between a pair of existing suspender cables hanging from each band. The horizontal bars support cables which in turn support decking of the work platform. The top ends of the struts are attached to the band by detaching an existing bolt and reattaching the bolt to attach the strut.

There is a need for a simpler and easier to install reliable method and means for attaching a platform beneath a bridge main cable.

Moreover, the requirement that the existing bands be used undesirably limits the positioning of the horizontal bars to the positions of the bands and undesirably limits the means of connecting the struts to whatever the existing band hardware is. It is thus considered desirable to have the freedom of placement of horizontal bars wherever it is desired they be placed along the main cable length and the freedom of choice of hardware for erecting a main cable platform.

Accordingly, it is an object of the present invention to provide locations for the horizontal bars and the use of hardware for hanging a main cable platform as determined by platform design. Thus, it is an object of the present invention to provide that the platform be a stand alone platform (i.e., not dependent for its design on the existing main cable bands).

It is another object of the present invention to provide a method and means for attaching such a platform beneath a bridge main cable which has simplicity and ease of installation and which is reliable.

In order to provide for such attachment of a platform in accordance with the above objects, in accordance with one aspect of the present invention, a plurality of slings are spaced longitudinally of the main cable and each extending around the main cable and attached at its ends to a respective elongate deck support. In order to restrain at least one of the slings from slippage along the length of the sharply sloping main cable, as seen in FIG. 1, a guy is attached to the at least one sling.

The above and other objects, features, and advantages of the present invention will be apparent in the following detailed description of preferred embodiments thereof when read in conjunction with the accompanying drawings wherein the same reference numerals denote the same or similar parts throughout the several views.

DETAILED DESCRIPTION OF PREFERRED EMBODIMENTS

Referring to FIGS. 2 to 6, there is illustrated generally at 40 a platform, attached to and underlying and extending along the length of a bridge main cable 22, which allows workers to walk thereon while performing maintenance on the bridge main cable 22.

Figure 2:
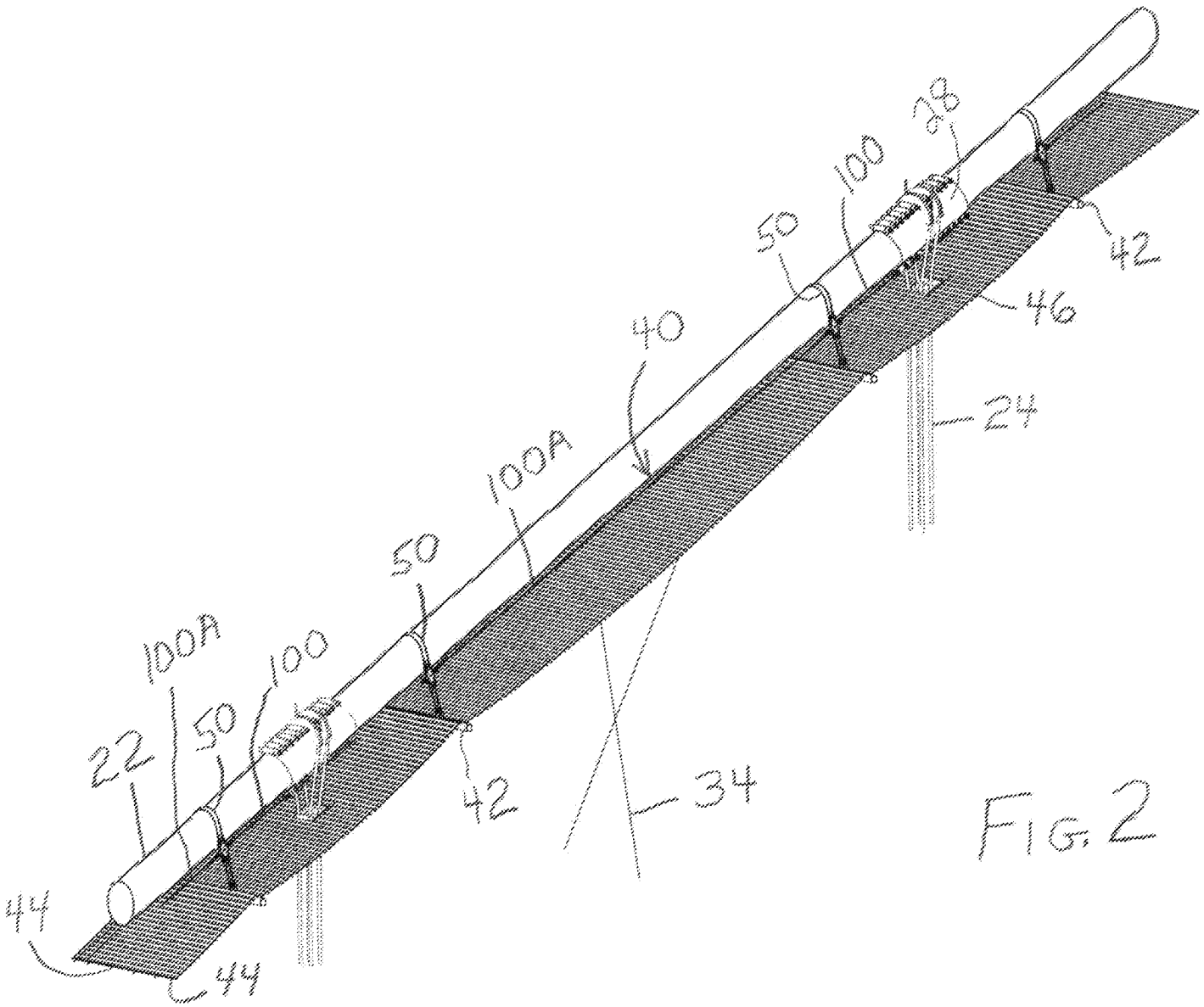
FIG. 2 is a partial perspective view, partially schematic, of a platform erected under a main cable of the bridge in accordance with the present invention.

The platform 40 comprises a series of transverse elongate rigid support beams or members 42 (transverse meaning cross-wise to the length of the platform 40, whereby it is also cross-wise to the length of the main cable 22). These support beams 42 are spaced generally equally over the length of the platform or spaced otherwise as suitable (for example, as illustrated in FIG. 2) and are each attached to the main cable 22 as discussed in greater detail hereinafter. These beams 42 may be, for example, square tubes or otherwise suitably shaped.

Figure 3:
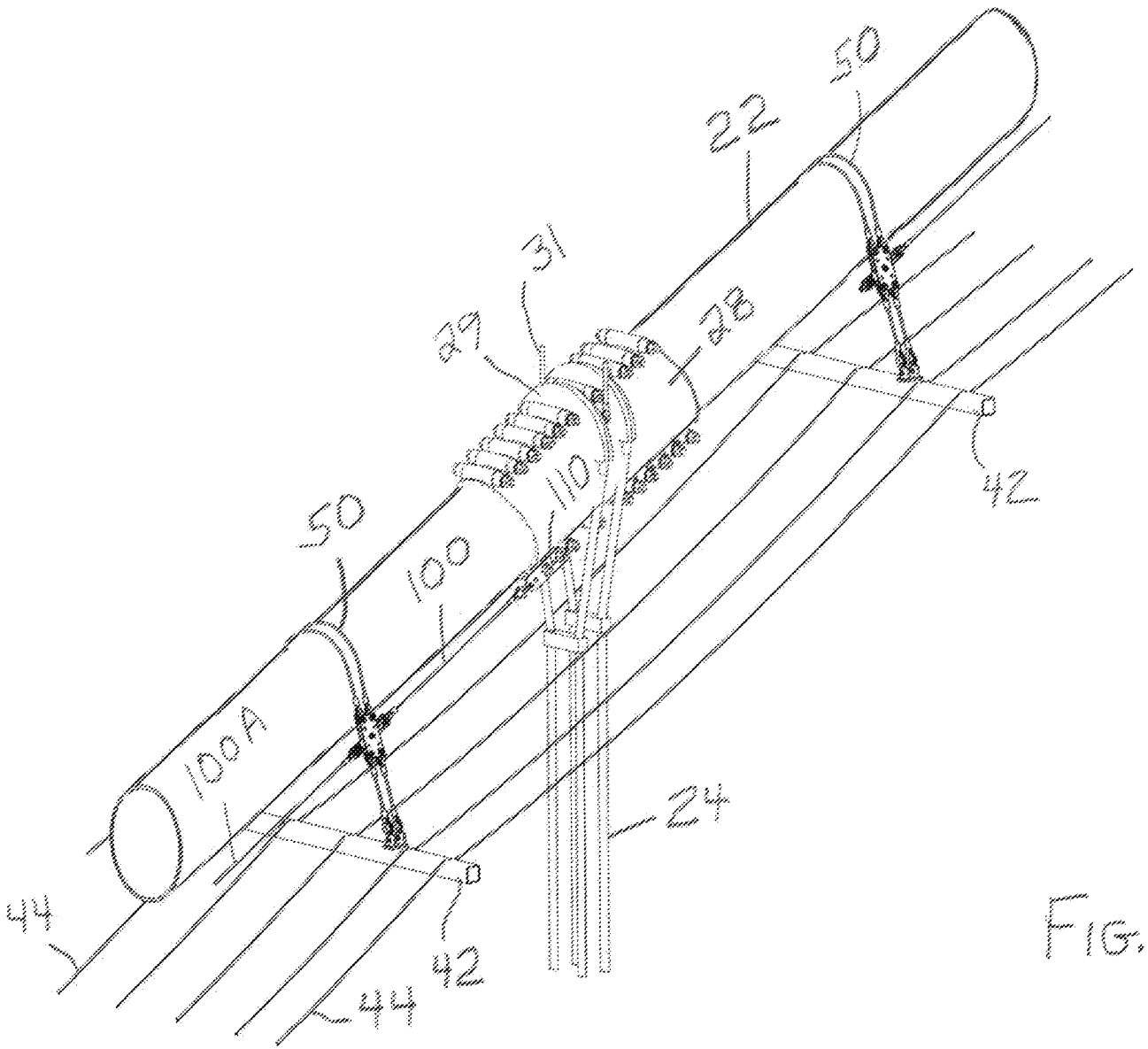
FIG. 3 is a view similar to that of FIG. 2 but without the decking, for ease of illustration.

As best seen in FIG. 3, a plurality of spaced decking support cables 44 (equally or otherwise suitably spaced) extend length-wise of the platform and thus also extend length-wise of the main cable 22 and over the support beams 42 (whereby the cables 44 are supported by the support beams 42) and are anchored at their ends to the bridge tower and/or to the bridge cable anchorage. The cables 44 may be clamped or otherwise suitably attached to the support beams such as by clamping.

Corrugated sheet metal or other suitable decking 46 is applied over and suitably attached to the cables 44 using principles commonly known to those of ordinary skill in the art to which the present invention pertains and/or as discussed in Assignee's aforesaid patents. Suitable openings, illustrated at 48, are provided in the decking 46 to allow passage of the hangers 24

Figure 4:
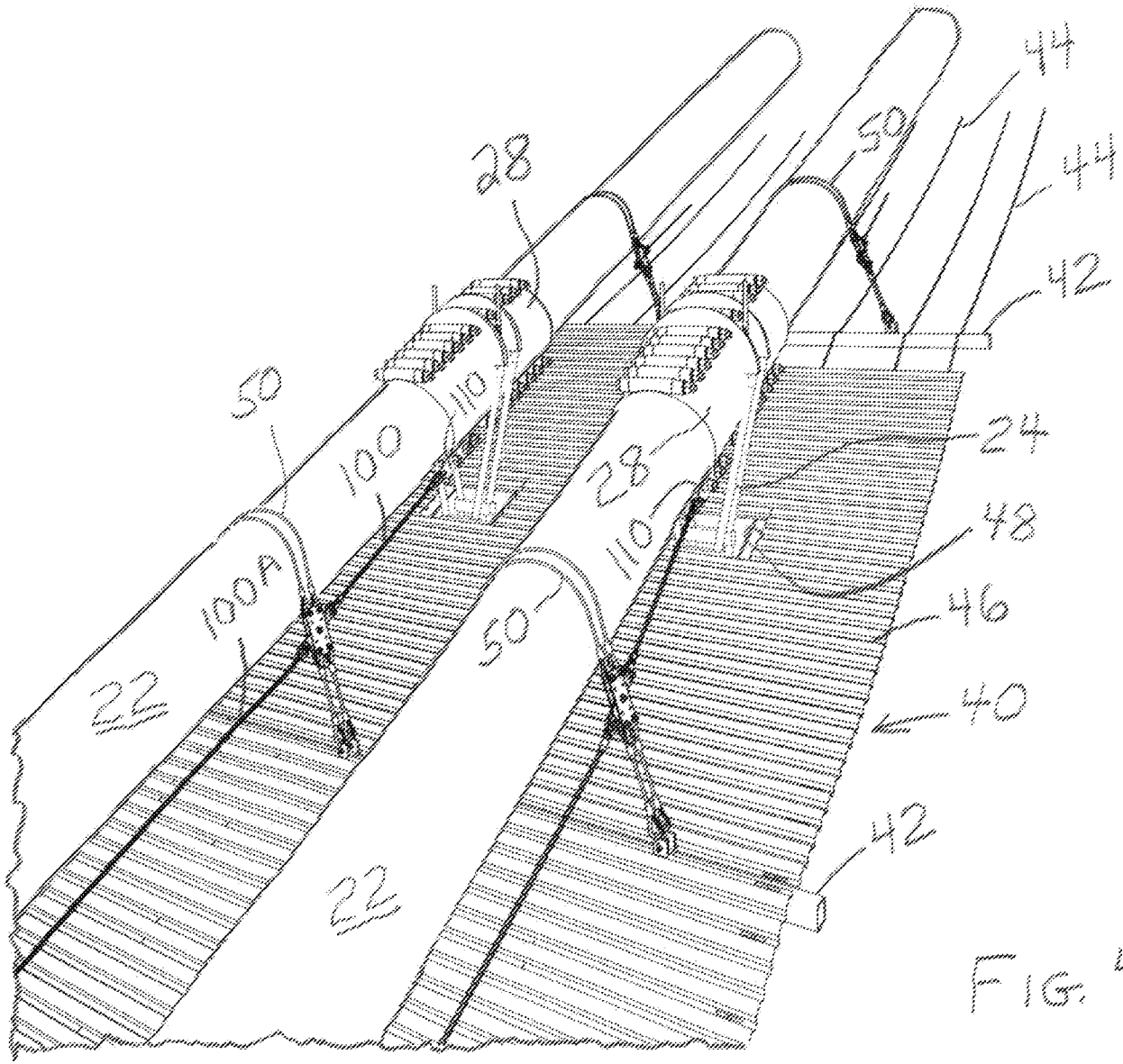
FIGS. 4 and 5 are views similar to that of FIG. 2, illustrating the platform erected under two adjacent main cables.
Figure 5:
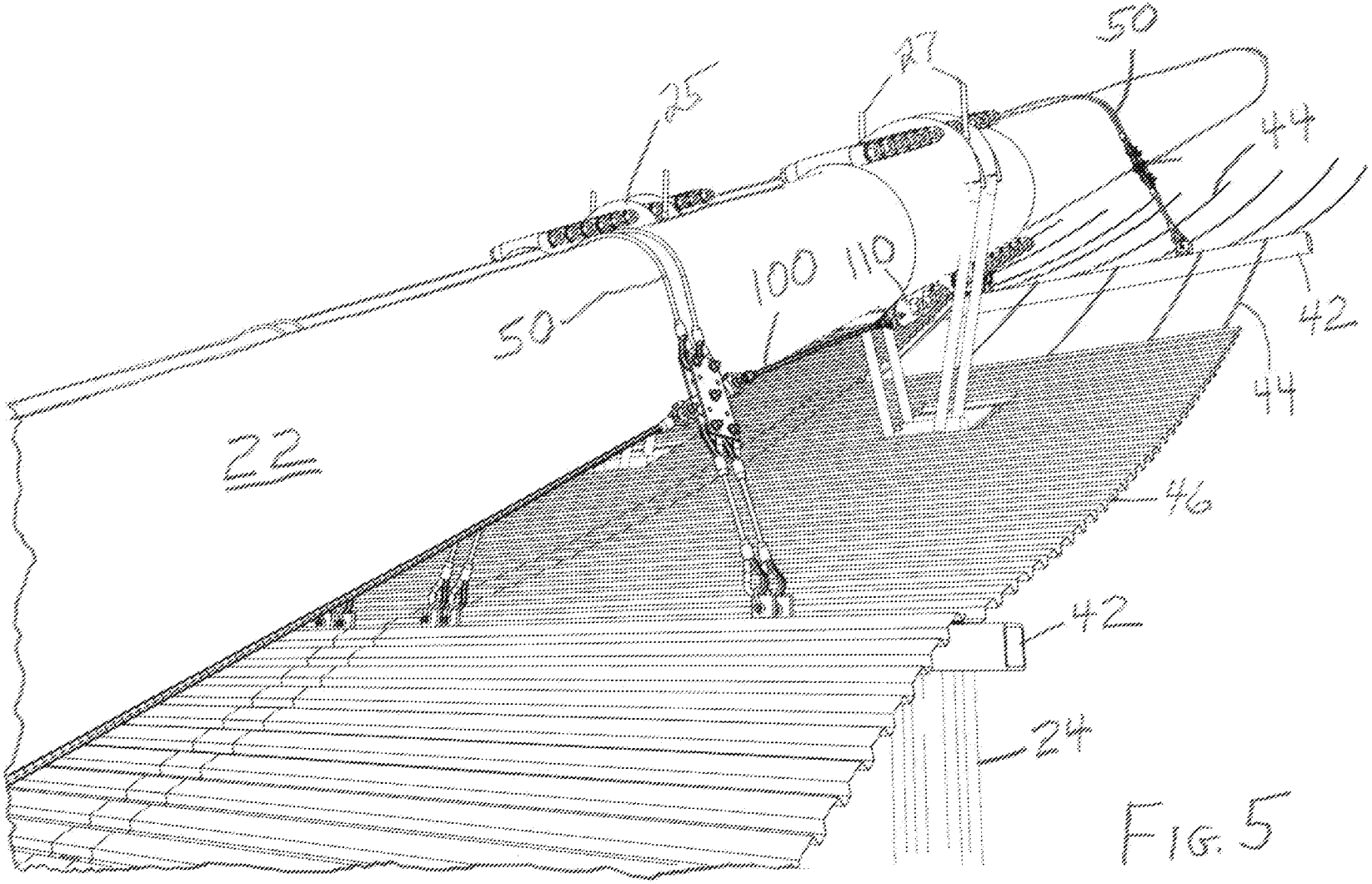

While the present invention is described herein as connected to a single main cable 22, it should be understood that a platform 40 may be provided which is connected to and underlies two or more parallel main cables 22, such as illustrated in FIG. 4.

In order to have the flexibility of placement of the support beams 42 anywhere along the main cable 22 as desired such as for engineering considerations, each support beam 42 is attached to the main cable 22 by a suitable sling 50 which is looped over the main cable 22 and suitably attached at its ends (in the form of eyelets 52) to the respective support beam 42.

Figure 6:
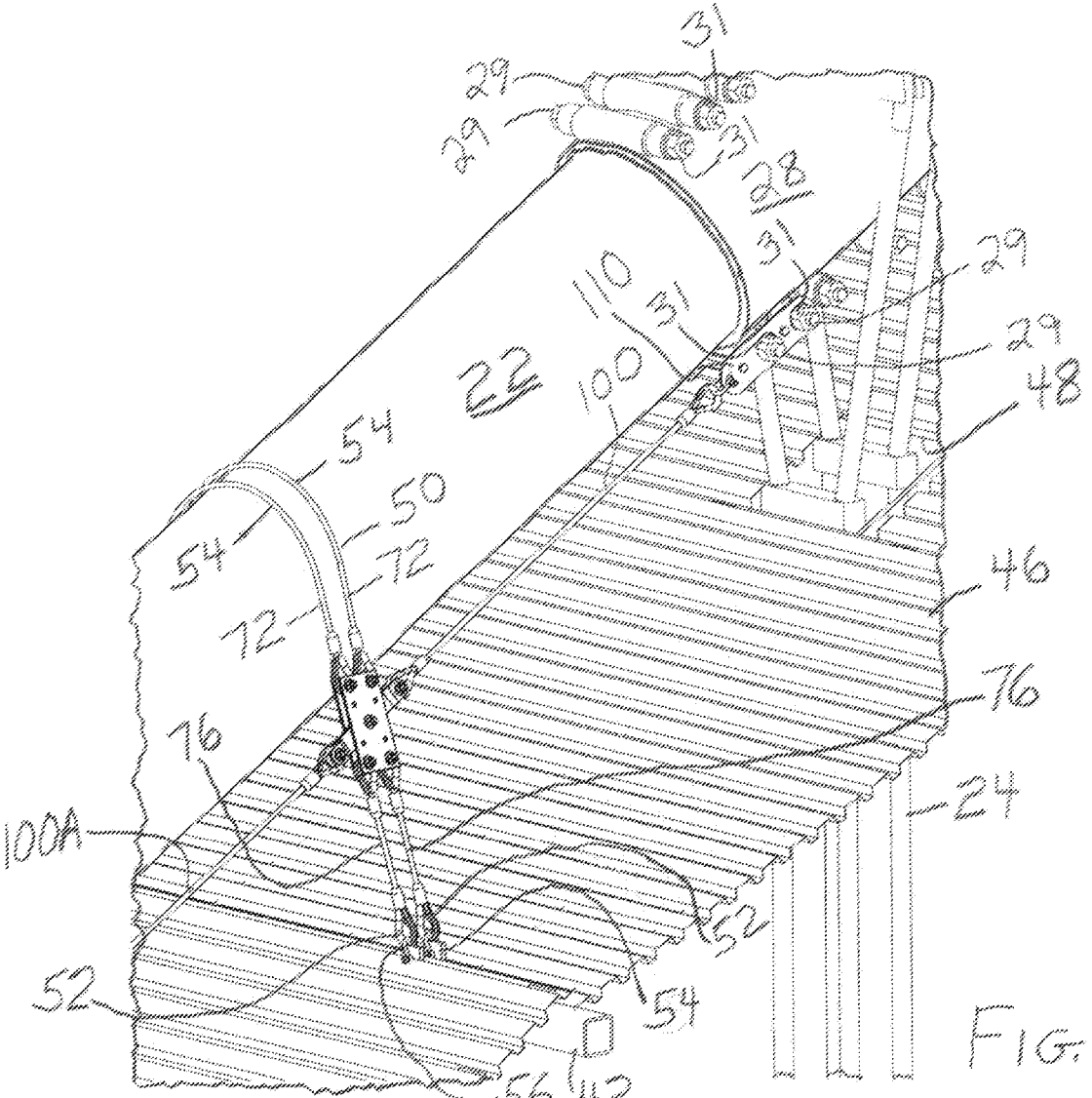
FIG. 6 is a view similar to those of FIGS. 2 to 5, illustrating an enlarged view of a guy structure for the platform.

A preferred form of the sling 50, best seen in FIG. 6, which may be called a "two-stranded sling" having a pair of cable strands 54 and eyelets 52 at each end for the strands 54 respectively is illustrated, it being understood that the sling 50 may be otherwise suitably constructed, such as for example as a "one-strand sling" having a single eyelet at each end. A suitable fitting or bracket 54 suitably supporting a pair of shackles 56 (a single shackle if a one-strand sling is employed) is welded or otherwise suitably attached to the respective support beam 42. The eyelets 52 are suitably received in and attached to the shackles 56 respectively at each end of the sling 50 thereby attaching the respective support beam 42 to the main cable 22, it being appreciated that the height of the platform 40 is determined by the overall length of the slings 50. A junction device, illustrated generally at 60, is interposed intermediate the length of the sling 50 desirable near the bottom of the main cable 22, and a second junction device 60 may, if desired, be provided on the opposite side of the main cable 22, as discussed in greater detail hereinafter and for purposes to be discussed hereinafter.

Figure 7:
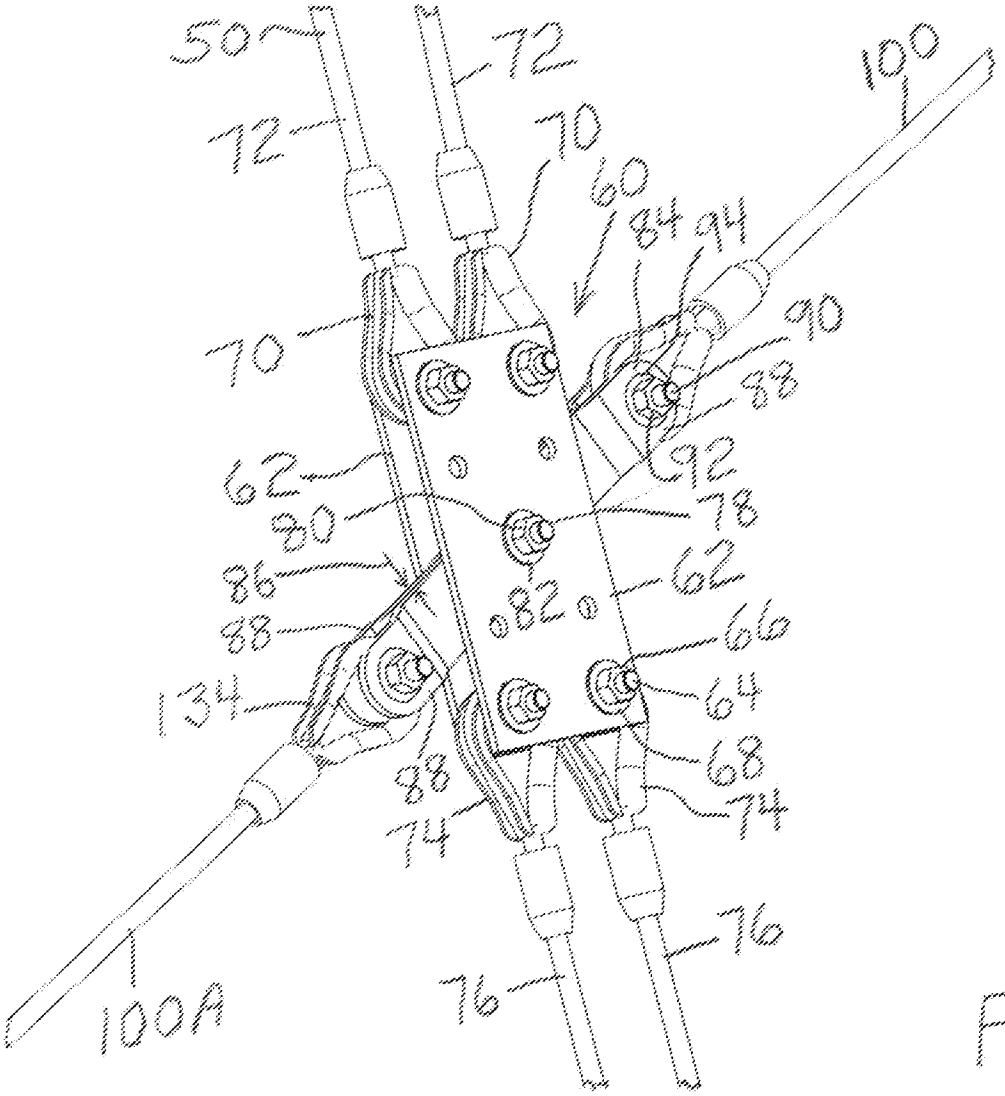
FIG. 7 is an enlarged perspective view of a junction device for attachment of sling lines and guys for the platform.

Referring to FIG. 7, the junction device 60 preferably comprises a pair of generally rectangular (or otherwise suitably shaped) plates 62 fastened tightly together at their corners, as with bolts 64, nuts 66, and washers 68. At one end of the device 60, eyelets 70 of one pair of strand segments 72 are received between the plates 62 and the respective bolts 64 received in the eyelets 70 thereby attaching the pair of strand segments 72 to the device 60. At the other end of the device 60, eyelets 74 of an other pair of strand segments 76 are received between the plates 62 and the respective bolts 64 received in the eyelets 74 thereby attaching the other pair of strand segments 76 to the device 60.

A fifth bolt or other suitable fastener 78 attaches the plates 62 generally centrally thereof and is tightened with a nut 80 and washer 82. An elongate member 84, preferably in the form of a pair of plates with their central portions welded together and with their outer end portions bent so as to be spaced from each other thereby defining at each end a pair of spaced ears 88, is received between the plates 62, and the bolt 78 received in an aperture (not shown) generally centrally of the member 84. The thickness, illustrated at 86, of the welded together central portions of the elongate member 84 is less than the spacing of the plates 62 so that the elongate member 84 may freely rotate about the bolt 78. The pair of ears 88 at each end are tightly connected by a fastener such as bolt 90, nut 92, and washer 94.

Figure 1:
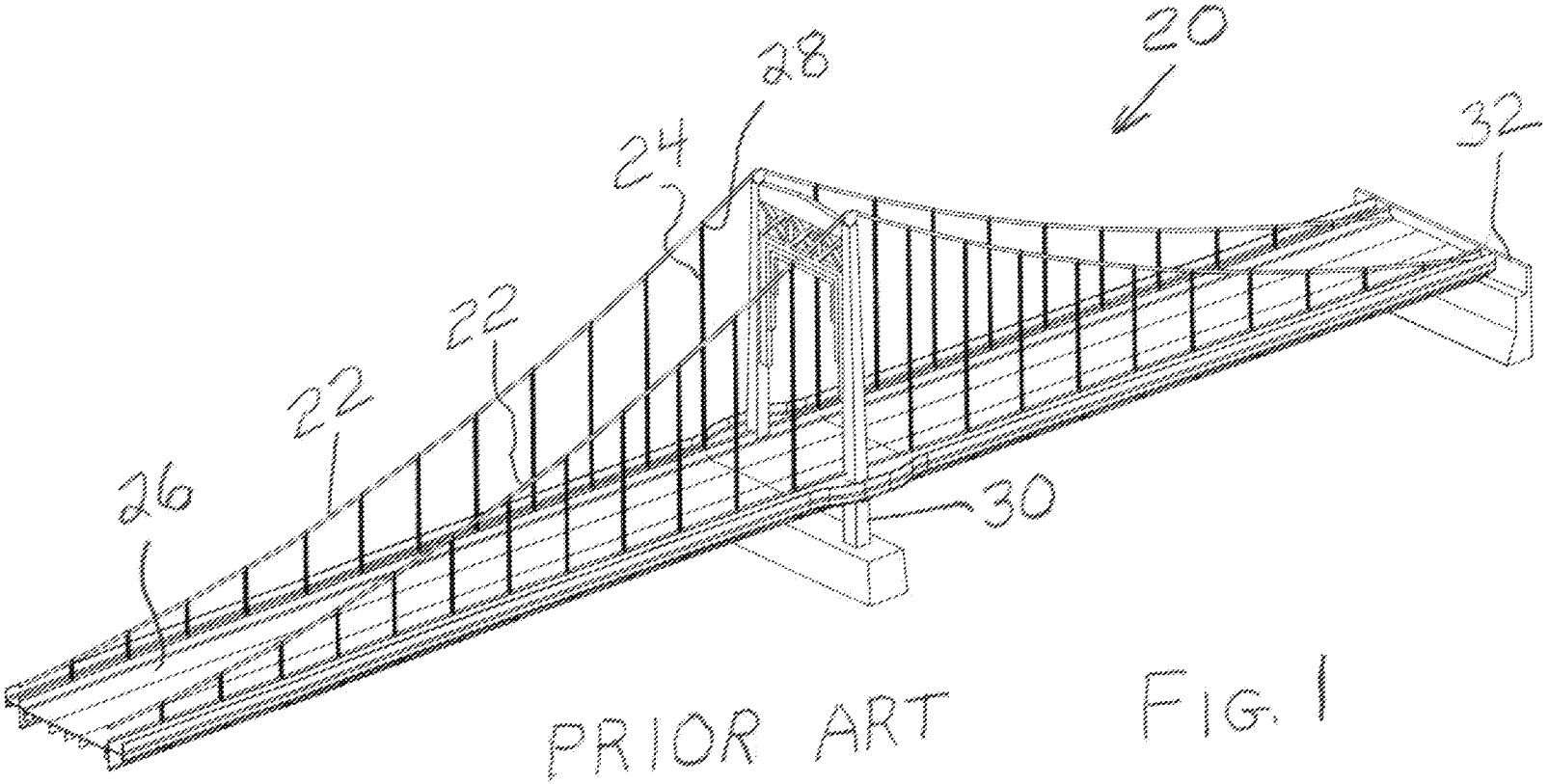
FIG. 1 PRIOR ART
FIG. 1 is a partial perspective view of a bridge to which the present invention may be applied.

As seen in FIG. 1, a bridge main cable 22 slopes at a steep angle with the result that, unless suitably restrained, the slings 50 may undesirably tend to slip downwardly along the main cable 22. In order to prevent such slippage, in accordance with the present invention, a restraint guy 100, in the form of a cable or other suitable form, is suitably attached to each sling 50. More preferably, a pair of guys 100 on opposite sides of the main cable 22 are suitably attached to each sling. Referring to FIG. 7, in accordance with a preferred such attachment, the guy 100 is formed to have an eyelet 102 at an end thereof, and the eyelet 102 is received between the pair of ears 88 on one end of the elongate member 84 and the bolt 90 received in the eyelet 102 thereby securing the guy 100 to the elongate member 84 and thus to the sling 50. It will be appreciated that the guy 100 may be attached to the sling 50 in various other ways, for example, by inserting the eyelet 102 between the plates 62 and receiving the bolt 78 in the eyelet 102.

Figure 8:
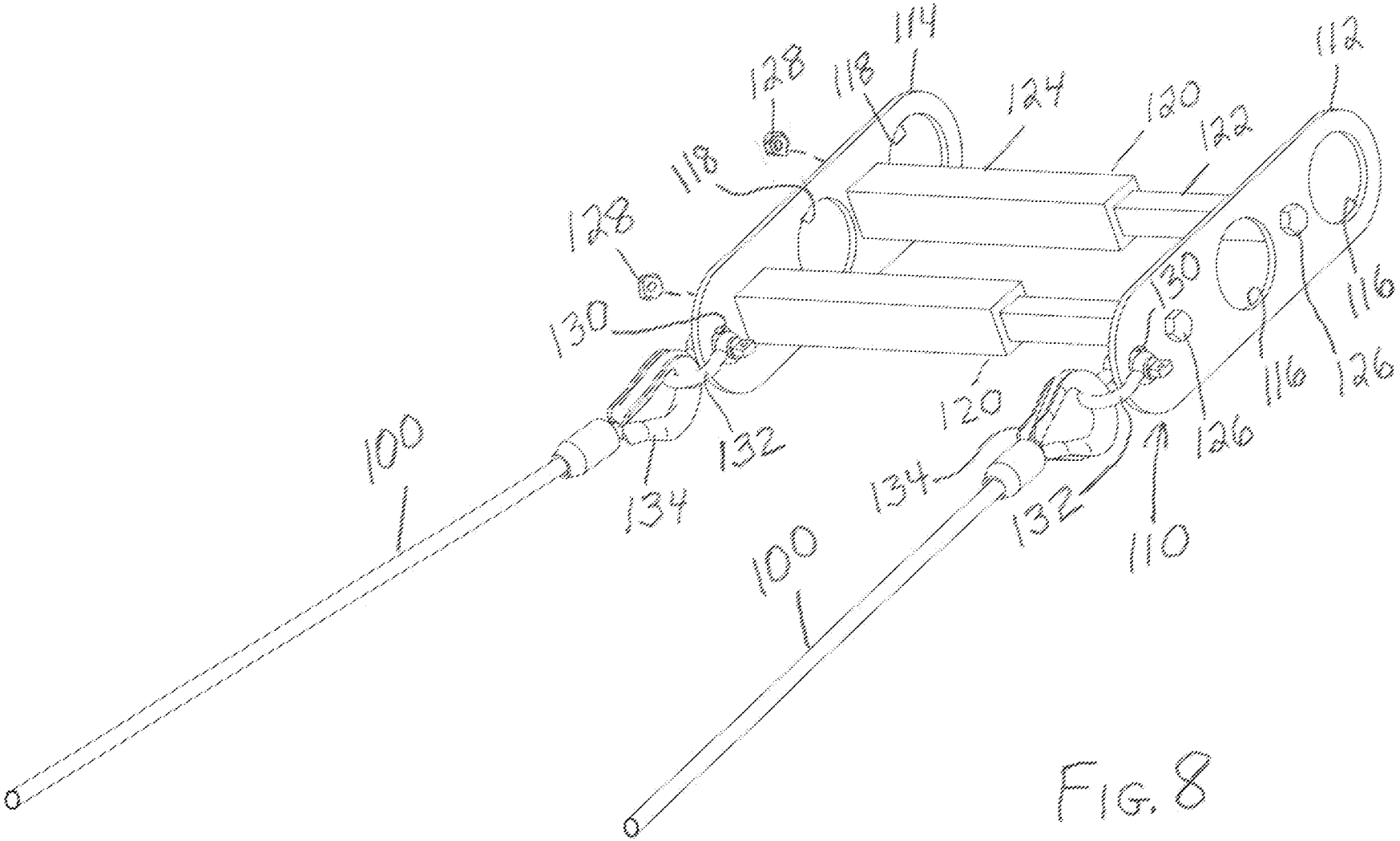
FIG. 8 is an enlarged perspective view of a device for attaching a guy for the platform to an existing main cable band.

The other end of the guy 100 may be anchored at any suitable anchor point. One preferred anchor point is found at the nearest band 28. As seen best in FIGS. 6 and 11, a band 28 is typically formed of segments connected upwardly by a series spaced lengthwise of the main cable 22 of long bolts 29 and nuts 31 and downwardly also by a similar series of long bolts 29 and nuts 31. Referring to FIG. 8, a guy anchoring fixture, illustrated generally at 110, is suitably attached to the nearest band 28 upwardly along the main cable 22 as will be discussed hereinafter. The anchor fixture 110 comprises a pair of plates 112 and 114 having any number such as, for example, two pairs, as shown, of aligned holes 116 and 118 respectively in which are received a like number, i.e., the heads of the first two bolts and the corresponding nuts respectively. The plates 112 and 114 are connected by a pair (or other suitable number) of telescoping mechanisms 120 comprising a smaller square (or otherwise suitably shaped) tube 122 welded at one end or otherwise suitably attached to one 112 of the plates and telescopingly received in a larger similarly shaped tube 124 welded at one end or otherwise suitably attached to the other 114 of the plates. A pair of fasteners such as bolts 126 are received in holes in one 112 of the plates and extend entirely through the tubes 122 and 124 and through holes in the other 114 of the plates and secured by nuts 128 threadedly received on threaded ends of the bolts 126. The anchor fixture 110 is securely attached to the band 28 by receiving the heads of band bolts 29 in the holes 116 and the band nuts 31 in the holes 118 and pressing the plates toward each other to snugly engage the band 28. The nuts 128 are threadedly applied to the ends of the bolts 126 and tightened thereby clamping the guy anchor fixture 110 to the band 28 thus providing a secure yet easily removable attachment of the guy anchor fixture 110 to the band 28. At the ends of the plates 112 and 114 (i.e., the ends directed away from the series of band bolts 29), a hole 130 is formed and a shackle 132 attached thereto.

The other ends of the guys 100 also are formed to have eyelets 134 which are received in and connected to the shackles 132 thereby attaching the other end of each guy 100 to the guy anchor fixture 110 and thus to the band 28, thereby to prevent undesirable slippage of the sling 50 downwardly along the main cable 22.

The guy 100 for a sling 50 may alternatively be anchored by attachment of its eyelet 134 to the closest other sling upwardly along the main cable 22. Referring again to FIG. 7 as well as to FIG. 2, the eyelet 134 of an other guy 100A, which emanates at its other end from another sling 50 similarly as guy 100 does, is received between the ears 88 on the other end of the elongate member 84 and the respective bolt 90 received in the eyelet 134 and the respective nut 92 tightened to anchor the guy 100A. Thus, as long as sling 50 is suitably held by guy 100 against slippage along the main cable 22, it may serve as an anchor for guy 100A from another sling 50 downwardly along the main cable 22 therefrom.

While two different anchors for guys 100 and 100A respectively have been shown and described, it should be understood that, in accordance with the present invention, other anchors may be provided for guys.

Figure 9:
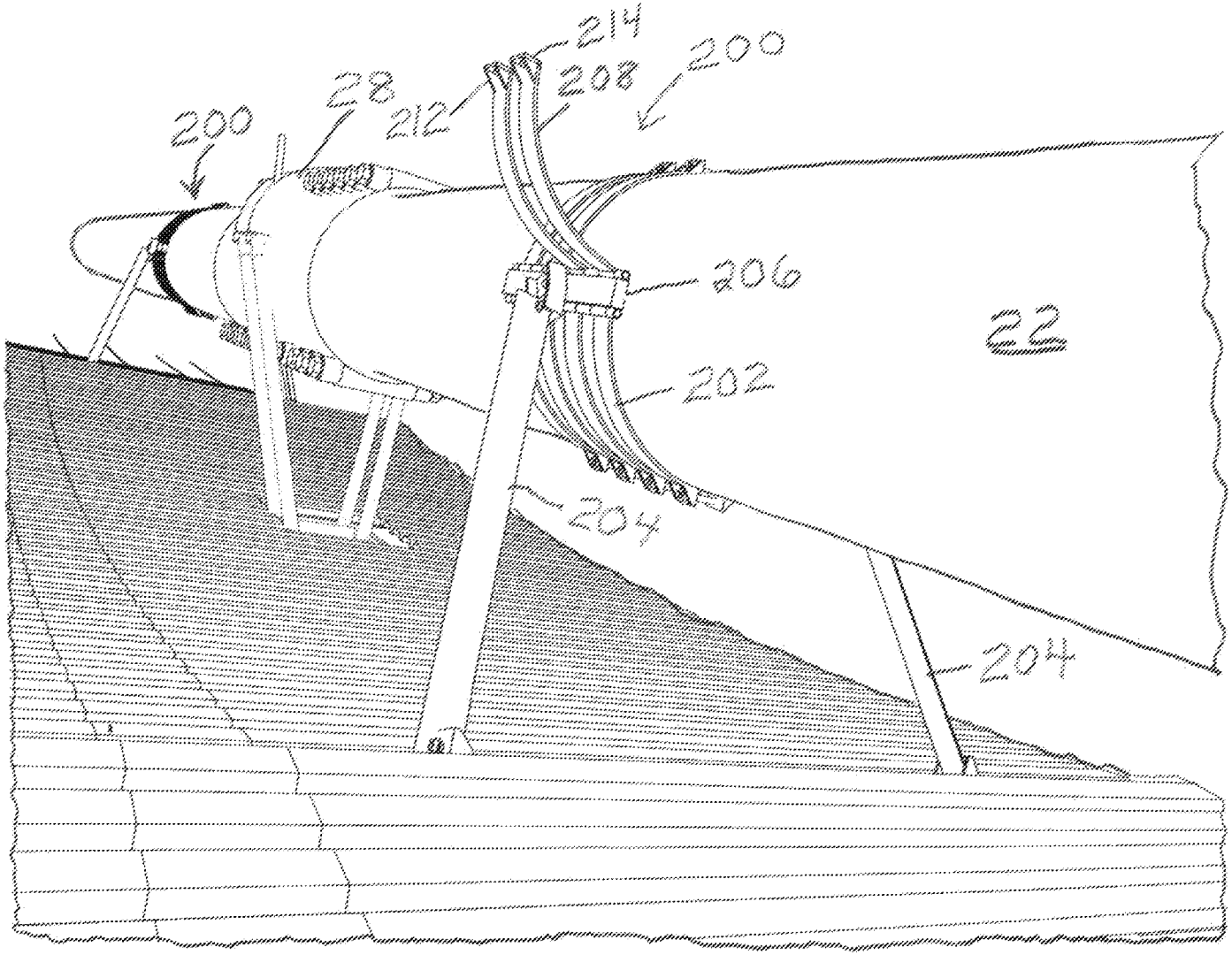
FIG. 9 is a partial perspective view of a platform erected under a main cable of the bridge in accordance with an alternative embodiment of the present invention.
Figure 10:
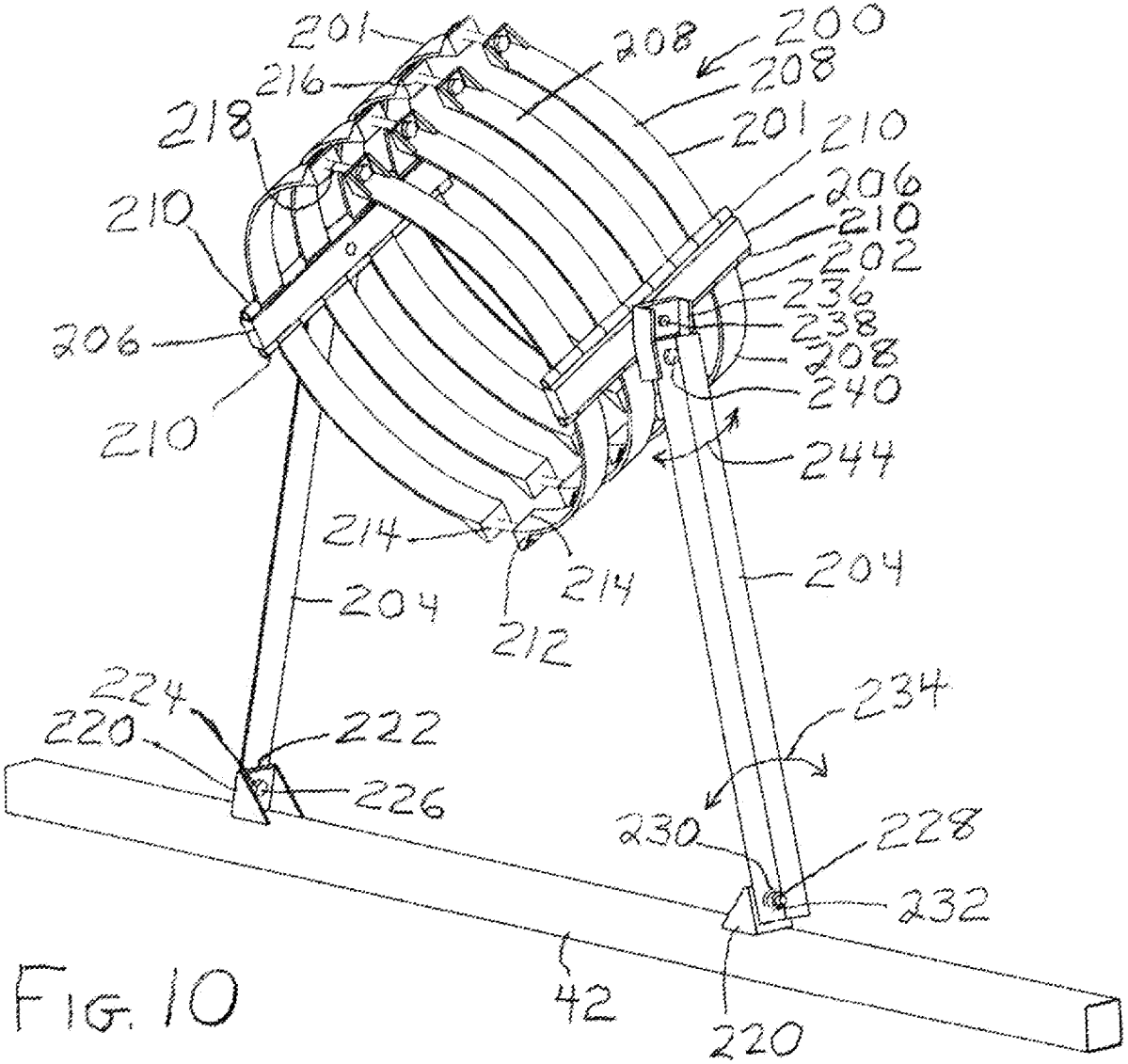
FIG. 10 is a perspective enlarged view of a main cable gripping device used for erecting the platform of FIG. 9.
Figure 11:
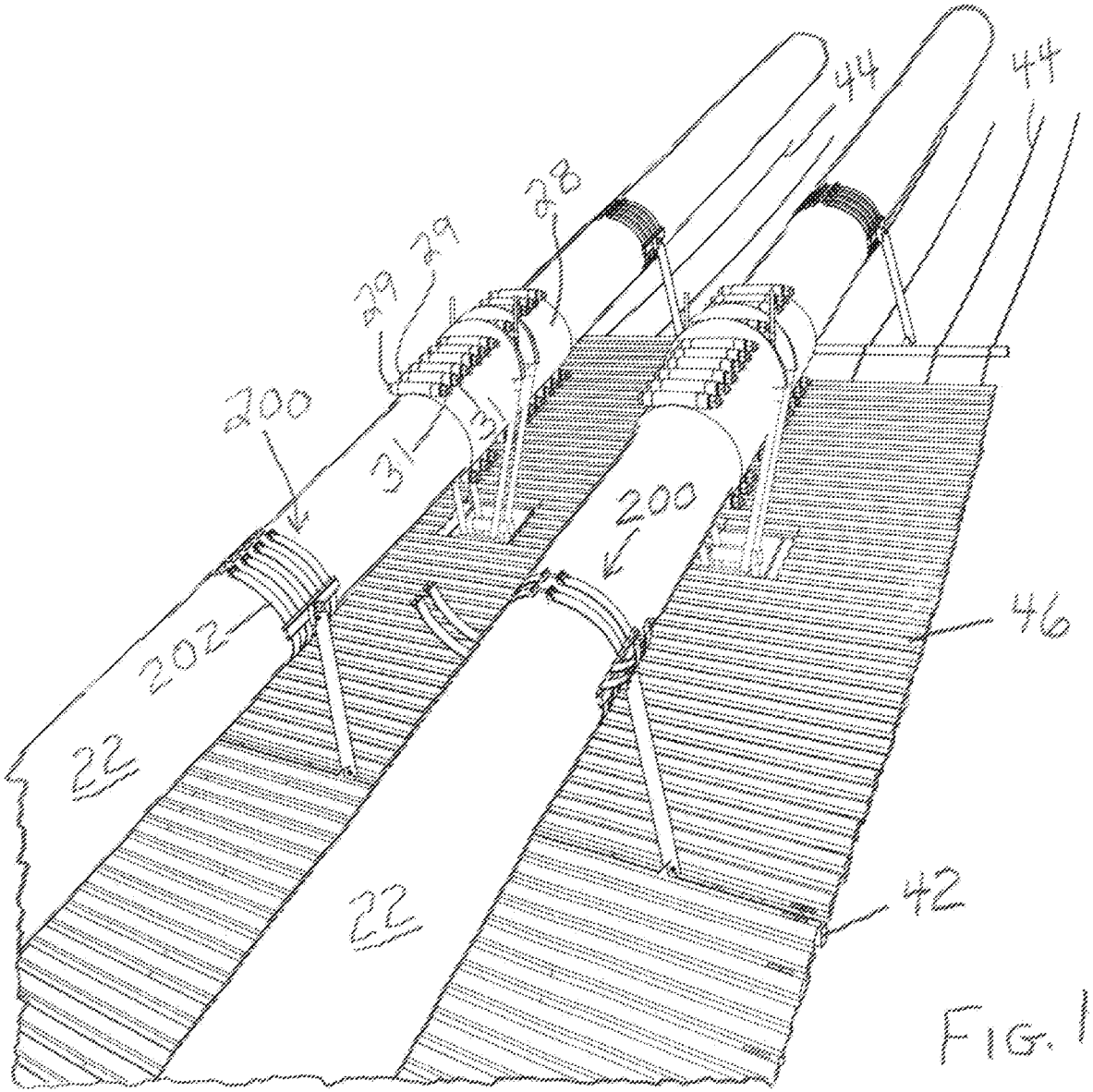
FIG. 11 is a view similar to FIG. 9 illustrating the platform of FIG. 9 erected under two adjacent main cables.
Figure 12:
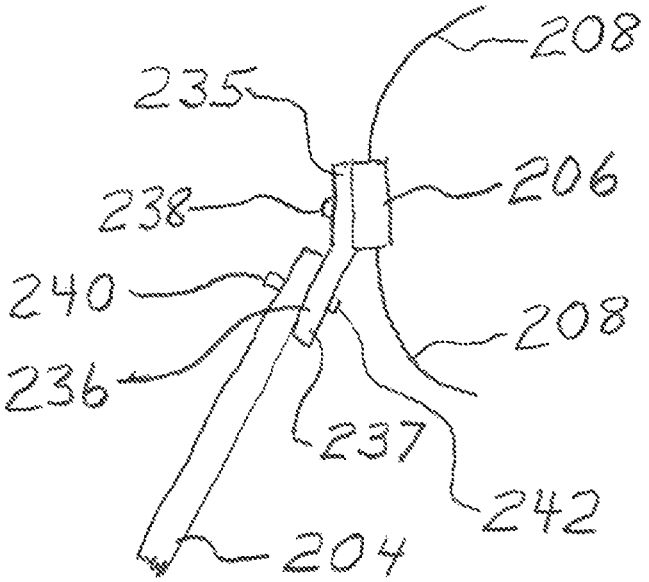
FIG. 12 is a detail view illustrating the attachment of a vertical beam to a clamp support plate for the gripping device.

Referring to FIGS. 9, 10, and 11, there is shown generally at 200 an alternative means of placement of the support beams 42 anywhere along the length of the main cable 22 as will best be in conformity at a selected location with engineering requirements or as otherwise may be desired. This alternative means 200 is in the form of a main cable clamp or gripping device 202 to which one (if the platform is erected to underlie a pair of main cables 22 as seen in FIG. 11) or preferably a pair of generally vertical beams 204 are attached at their upper ends and which are attached at their lower ends to the respective support beam 42. Thus, each support beam 42 must be supported by such vertical beams 204 at two or more locations over its length.

The clamp comprises a pair of diametrically opposed rectangular or otherwise suitably shaped support members 206 which when the clamp 202 is clampingly engaged to the main cable 22 are disposed to extend lengthwise of the main cable 22 and about mid-height of the main cable 22. At least one but preferably a plurality of elongate portions 208 are hingedly attached to each support member 206 by means of well-known hinges 210 along each elongate edge of the support member 206. Thus, each support member 206 and its associated elongate portions may be said to comprise half 201 of the clamp 202. Each elongate portion 208 is curved to conform to the circumference of the main cable 22 and sized to extend approximately over a quarter (or 90 degrees) of the main cable circumference. Thus, a sequence of four such curved elongate portions 208 (generally in end-to-end relation) will extend entirely around the circumference of the main cable 22. Suitable pads (not shown) may underlie and be suitably adhesively or otherwise attached to each of the curved elongate portions 208 to aid in providing suitably tight and stable clamping to the main cable 22.

The ends of the curved elongate portions 208 opposite the hinges 210 are provided with suitable brackets 212, which may be welded or otherwise suitably attached thereto, providing faces 214 on one half 201 of the clamp for engaging respective faces 214 of brackets 212 on the other half 201 of the clamp. These faces 214 have centrally located apertures, illustrated at 216. A bolt or other suitable fastener 218 such as a threaded stud is received in corresponding apertures 216 of each pair of engaged faces 214 and a suitable nut or nuts applied and the fasteners 218 suitably tightened to clamp the clamp 202 to the main cable 22.

The number of curved elongate portions 208 extending from a hinge 210 is shown in the drawings to be 4. However, the number of curved elongate portions 208 extending from a hinge 210 may vary based on engineering requirements or other reasons. Thus, to provide sufficient friction to suitably support the platform load, engineering principles may require a minimum clamping surface area which may thus require a minimum number of such curved narrow elongate portions 208 or a lesser number (even one) of wider elongate portions 208. For example, for a typical main cable 22 of 1 to 3 feet in diameter, the total width of curved elongate portions 208 (the sum of widths of the curved elongate portions 208) emanating from a hinge may be about 2 feet (i.e., each of the 4 curved elongate portions 208 shown in the drawings may have a width of about 6 inches, and 4×6 inches=2 feet). To achieve the same square footage, the 4 curved elongate portions 208 may be replaced by a single one having a width of about 2 feet. An advantage of having a larger number of narrower curved elongate portions 208 is reduced weight.

A bracket 220 is welded or otherwise suitably attached to the support beam 42 for attachment of each of the vertical beams 204. The bracket 220 is provided with a face 222 having an aperture, illustrated at 224, centrally therein. A bolt or other suitable fastener 226 is received in an aperture, illustrated at 228, in a facing planar portion of the lower end of the vertical beam 204 and in the corresponding bracket aperture 224, a suitable washer 230 applied, and a suitable nut 232 applied and tightened to attach the vertical beam 204 to the respective support beam 42. Note that the vertical beam 204 is rotatable or swingable relative to the bracket 220 (when the fastener 226 is not tightened), as illustrated at 234, to allow the respective clamp half 201 to be easily swung or swiveled into position.

Figure 13:
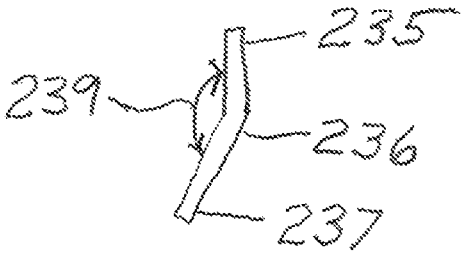
FIG. 13 is a detail view illustrating the angle formed by a bracket for the attachment of the vertical beam to the clamp support plate.

An upper portion 235 of a bracket 236 is pivotally or rotatably attached to the support member 206 intermediate the ends thereof by suitable means such as fastener 238. The bracket 236 has a lower portion 237 which is angled thereto at a suitable angle, illustrated at 239 in FIG. 13, to take into account the orientation of the clamp 202 at its particular position along the parabolic main cable 22 so that the vertical beam 204 is not skewed thereto when pivotally attached thereto as hereinafter discussed. Thus, the particular angle formed by the bracket 236 will be different for different positions of the clamp 202 along the main cable 22 and can be determined using principles commonly known to those of ordinary skill in the art to which the present invention pertains. An upper planar portion of the vertical beam 204 is fixedly or rigidly attached to the lower portion 237 of the bracket 236 by suitable means such as bolt 240 and nut 242 or by other suitable fastener or welding thus allowing swiveling as illustrated at 244 of the vertical beam and bracket 236 combination about fastener 238.

The aforementioned pivotal attachments of a vertical beam 204 at a selected angle 239 allow the clamp 202 to be attached at different locations along the parabolic curvature of the main cable 22 without the vertical beam 204 being undesirably skewed relative to the respective support member 206. These pivotal attachments at 226 and 238 also allow the clamp 202, after detachment from the main cable, to easily be pivoted down onto the deck 46 and pivoted back up to be clampingly attached to the main cable 22.

As seen in the drawings, a clamp 202 may be said to have two lower quadrants and two upper quadrants. The two lower quadrants may remain joined together and are tightened once the clamp 202 is applied to the main cable 22. In order to mount the clamp 202, the clamp 202, with the vertical beams 204 loosely but not tightly attached thereto and with the support beam 42 loosely but not tightly attached to the vertical beams 204, is hoisted into position with a crane or other suitable means so that the lower quadrants engage the lower half of the circumference of the main cable 22. The curved elongate portions 208 for the upper quadrants are then hingedly moved into position for insertion of fasteners 218 which are then inserted and nuts applied and tightened (and the fasteners 218 for the lower quadrants also tightened) to clampingly engage the clamp 202 to the main cable 22. The fasteners 226 and 238 are then suitably tightened to firmly hold the support beam 42 in the desired position. With the support beams 42 in position, the erection of the platform 40 may then be achieved using principles commonly known to those of ordinary skill in the art to which the present invention pertains and/or as discussed in Assignee's aforesaid patents.

It should be understood that, while the present invention has been described in detail herein, the invention can be embodied otherwise without departing from the principles thereof. Such other embodiments are meant to come within the scope of the present invention as defined by the appended claims.

What is claimed is:

1. A method for erecting a platform so that it is suspended from at least one main cable of a bridge, the method comprising the steps of:

a) applying a plurality of slings to the at least one main cable so that the slings are spaced along the at least one main cable and so that each of the slings extends around the at least one main cable;

b) attaching ends of each of the slings to a respective one of a plurality of elongate decking support beams, with the support beams being spaced apart and extending cross-wise of and disposed below the at least one main cable;

c) attaching one end of at least one guy in the form of a cable to at least one of the slings intermediate ends of the at least one of the slings, and extending the at least one guy between the at least one of the slings and an anchor point and substantially parallel to the at least one main cable; and d) applying decking to the support beams.

2. A method according to claim 1 further comprising selecting the anchor point to be structure attached to the at least one main cable.

3. A method according to claim 1 further comprising selecting the anchor point to be a band which is attached to the at least one main cable.

4. A method according to claim 1 further comprising clamping a device to a band attached to the at least one main cable and selecting the anchor point to be the clamped device.

5. A method according to claim 1 wherein the step of attaching the one end of the at least one guy to the at least one of the slings includes providing in the at least one of the slings intermediate the length thereof at least one junction device having at least one first plate to opposite ends of which cables respectively of the at least one of the slings are attached and at least one second plate pivotally attached to the at least one first plate, and attaching the one end of the at least one guy to one end of the second plate.

6. A method according to claim 5 further comprising selecting the anchor point to be an other end of the second plate of an other of the junction device of an other of the slings.

7. A method according to claim 5 further comprising selecting an other end of the second plate to be an anchor point for an other of said at least one guy for an other of said slings.

8. A method for erecting a platform so that it is suspended from at least one main cable of a bridge, the method comprising the steps of:

a) providing at least one sling wherein cables are attached to opposite sides respectively of at least one device whereby the at least one device is intermediate ends of the at least one sling;

b) applying a plurality of the at least one sling to the at least one main cable so that the slings are spaced along the at least one main cable and so that each of the slings extends around the at least one main cable;

c) attaching ends of each of the slings to a respective one of a plurality of elongate decking support beams respectively, with the support beams being spaced apart and extending cross-wise of and disposed below the at least one main cable;

d) attaching one end of at least one guy in the form of a cable to the at least one device, and extending the at least one guy between the at least one device and an anchor point and substantially parallel to the at least one main cable; and e) applying decking to the support beams.

9. A method according to claim 8 further comprising selecting the anchor point to be structure attached to the at least one main cable.

10. A method according to claim 8 further comprising selecting the anchor point to be a band which is attached to the at least one main cable.

11. A method according to claim 8 further comprising clamping a device to a band attached to the at least one main cable and selecting the anchor point to be the clamped device.

12. A method according to claim 8 further comprising providing the device to have a first plate to opposite ends of which the cables are attached respectively and a second plate which is pivotly attached to the first plate, wherein the step of attaching the one end of the at least one guy to the at least one device includes attaching the one end of the at least one guy to one end of the second plate.

13. A method according to claim 12 further comprising selecting the anchor point to be an other end of the second plate of an other of the device of an other of the slings.

14. A method according to claim 12 further comprising selecting an other end of the second plate to be an anchor point for an other of said at least one guy for an other of said slings.

15. A method for erecting a platform so that it is suspended from at least one main cable of a bridge, the method comprising the steps of:

a) providing at least one sling wherein cables are attached to opposite sides respectively of a first plate of at least one device whereby the at least one device is intermediate ends of the at least one sling;

b) applying a plurality of the at least one sling to the at least one main cable so that the slings are spaced along the at least one main cable and so that each of the slings extends around the at least one main cable;

c) attaching ends of each of the slings to a respective one of a plurality of elongate decking support beams, with the support beams being spaced apart and extending cross-wise of and disposed below the at least one main cable;

d) providing the at least one device to have a second plate which is pivotly attached to the first plate;

e) attaching one end of at least one guy in the form of a cable to one end of the second plate, and extending the guy from the second plate to an anchor point and substantially parallel to the at least one main cable; and f) applying decking to the support beams.

16. A method according to claim 15 further comprising selecting the anchor point to be a structure attached to the at least one main cable.

17. A method according to claim 15 further comprising selecting the anchor point to be a band which is attached to the at least one main cable.

18. A method according to claim 15 further comprising clamping a device to a band attached to the at least one main cable and selecting the anchor point to be the clamped device.

19. A method according to claim 15 further comprising selecting the anchor point to be an other end of the second plate of an other of the device of an other of the slings.

20. A method according to claim 15 further comprising selecting an other end of the second plate to be an anchor point for an other of said at least one guy for an other of said slings.

* * * * *